United States Patent [19]

Rowe, Jr. et al.

[11] 4,056,409

[45] Nov. 1, 1977

[54] INCREASING TOPCOAT ADHESION FOR SOLVENT PHOSPHATIZED SURFACES

[75] Inventors: Edward A. Rowe, Jr., Mentor; William H. Cawley, Painesville, both of Ohio

[73] Assignee: Diamond Shamrock Corporation, Cleveland, Ohio

[21] Appl. No.: 709,263

[22] Filed: July 28, 1976

[51] Int. Cl.[2] ..... C23F 7/10

[52] U.S. Cl. ..... 148/6.15 R; 148/31.5

[58] Field of Search ..... 148/6.15 R, 6.15 Z, 148/31.5

[56] References Cited

U.S. PATENT DOCUMENTS

| | | | |
|---|---|---|---|
| 3,100,728 | 8/1963 | Vullo et al. | 148/6.15 R |
| 3,197,345 | 7/1965 | Vullo et al. | 148/6.15 R |

*Primary Examiner*—Ralph S. Kendall

*Attorney, Agent, or Firm*—John J. Freer

[57] ABSTRACT

Topcoat adhesion is now increased for coatings applied over a solvent phosphatized metallic surface. The phosphatized surface is obtained from a composition that can contain methylene chloride, as well as water in minor amount, and yet maintain a continuous and homogeneous liquid phase. Resulting phosphatized metallic surfaces are often topcoated. By adjusting the constituency of the phosphatizing composition, such as by augmenting the water content, topcoat adhesion can be markedly enhanced.

16 Claims, No Drawings

INCREASING TOPCOAT ADHESION FOR SOLVENT PHOSPHATIZED SURFACES

BACKGROUND OF THE INVENTION

In pending application Ser. No. 560,378, now U.S. Pat. No. 4,008,101 there are disclosed phosphatizing compositions which contain methylene chloride and water, while having a continuous and homogeneous liquid phase. From such compositions, phosphatized coatings on metal surfaces have at least substantial water insolubility. The liquid phase contains water in minor amount, thus retaining the desirable process characteristics associated with solvent phosphatizing.

Resulting phosphatized metal surfaces are often topcoated. Topcoating can be done with a variety of paints or the like. Subsequent curing of applied topcoat composition might proceed under a variety of conditions, including modest to elevated temperature, heat cure conditions. It would be desirable to achieve excellent topcoat adhesion for coating compositions that are cured under such variety of conditions.

SUMMARY OF THE INVENTION

Topcoat adhesion can now be significantly enhanced following the making of adjustments to the constituency of the phosphatizing composition. And importantly, other attractive aspects of the phosphatized coating are not deleteriously affected. Through augmenting the concentration in the phosphatizing composition of water and/or solubilizing solvent, e.g., methanol, or by adding to the composition, or by augmenting the concentration, of aprotic polar organic compound, phosphate coatings from the resulting composition can have significantly increased topcoat adhesion. Additions of such ingredients in combinations are also most effective.

In brief, the invention is directed to the process of forming a phosphatized coating on a metal substrate, wherein coating formation proceeds through contact of the surface of the metal substrate with a methylene chloride and water-containing liquid phosphatizing composition having a continuous and homogeneous liquid phase containing water in minor amount, with the composition being capable of forming a phosphatized coating of substantial water insolubility on the metal surface. Most particularly, the improvement is for forming on the metal surface a phosphate coating that has enhanced topcoat adhesion. The improvement comprises blending with the phosphatizing composition constituents selected from the group consisting of water, aprotic polar organic compound, solubilizing solvent capable of solubilizing phosphoric acid in methylene chloride, and mixtures thereof, and then contacting the surface to be coated with the resulting phosphatizing composition.

In another aspect the invention is directed to a phosphatizing composition that will form coatings on metal surfaces, with the coatings providing enhanced topcoat adhesion. In yet another aspect the invention is directed to combining an adjuvant composition with additional substances to prepare a phosphatizing composition as herein described.

DESCRIPTION OF THE PREFERRED EMBODIMENTS

The methylene chloride phosphatizing compositions are disclosed in pending U.S. application Ser. No. 560,378 now U.S. Pat. No. 4,008,101. Briefly, they may contain commercially available methylene chloride, which might contain additional ingredients, although the use of a more purified methylene chloride is contemplated. The methylene chloride may then contain very minor amounts of stabilizers such as cyclohexane. The methylene chloride might be blended with additional solvent. Preferably, the additional solvent will be nonflammable and will form an azeotrope with the methylene chloride on heating, e.g., trichlorotrifluoroethane, which can be useful in up to a 50/50, by weight, blend. Although the methylene chloride will generally provide the major amount of the liquid phosphatizing solution and will typically provide between about 60 to about 90 weight percent of such solution, this need not be the case. In such situation, the solubilizing solvent will likely be the predominant substituent in the solution.

The solubilizing solvent needs to be one or a mixture that is capable of solubilizing phosphoric acid in methylene chloride. The solvent can also affect other characteristics of the phosphatizing solution, e.g., the solvent may have an effect on the solubility of water in the phosphatizing solution. The solvent can be, and on occasion most desirably is, a blend of organic substances. Most advantageously for efficiency of operation the solubilizing solvent is an alcohol having less than six carbon atoms. Alcohols of six carbon atoms or more may be used, but should always be present in minor amount with at least one less than six carbon atoms alcohol being in major amount. Representative alcohols that can be or have been include methanol, ethanol, isopropanol, n-pentanol, n-propanol, n-butanol, allyl alcohol, sec-butanol, tert-butanol and their mixtures wherein liquid phase homogeneity is maintained when in mixture with methylene chloride. However, additional substances, e.g., 2-butoxyethanol, can also be serviceable, alone or in combination with alcohol. Preferably for efficiency and economy the organic solvent is methanol.

The phosphoric acid is a critical ingredient that is generally present in a very minor amount, but with the solubilizing solvent, the acid may be contained in the phosphatizing solution in substantial amount. Such amount might be up to 2–3 weight percent or more, although an amount below even 0.1 weight percent can be serviceable.

The phosphatizing solution will be useful for phosphatizing aluminum, zinc, cadmium and tin substrates as well as the more typical ferruginous metal substrates. The "phosphatizing proportion of phosphoric acid," as such term is used herein, may well be a "phosphatizing substance," as it might more appropriately be termed. Such terms are not meant to exclude any substances that may be, or have been, useful in the solvent phosphatizing art for providing a phosphate coating. Such substances might thus include organic phosphate substance as well as the more typical acidic substances of phosphorous, e.g., the usual orthophosphoric acid.

The amount of the phosphatizing substance in the phosphatizing solution is exceeded by the amount of water present in such solution. Water must be present in at least an amount sufficient to provide a phosphatized coating on ferrous metal of substantial water insolubility. However, saturation is not exceeded as the solution will then lose liquid phase homogeniety. For many of the phosphatizing solutions, on one hand water insoluble coatings are achieved, coupled with an acceptable coating weight, when the water content of the solution reaches about 1.5–2.5 weight percent. On the other hand, phase separation for many solutions can occur when the water content reaches about 5–7 weight percent, basis total solution weight. The water will always provide a minor weight amount of the phosphatizing solution, and it will most always be present in an amount within the range of about 2–5 weight percent.

Basic to the "phosphatizing solution," "phosphatizing composition," or "methylene chloride and water-containing liquid phosphatizing composition," as such terms are used herein, are the methylene chloride, solubilizing solvent, phosphatizing proportion of phosphoric acid, and the water. A further substance that may be present in the phosphatizing solution is an aprotic organic substance. It is preferred for efficient coating operation to use dipolar aprotic organic compounds, and such are generally present in an amount less than the amount of the solubilizing solvent. Although they are serviceable when used on the order of ten to fifteen weight percent or more of the composition, enhanced topcoat adhesion may be obtained with resulting coatings from compositions to which about 3 to about 5 weight percent of compound have been added. The aprotic organic compound is often a nitrogen-containing compound; these plus other useful compounds include N,N-dimethyl formamide, dimethyl sulfoxide, acetonitrile, acetone, nitromethane, nitrobenzene, tetramethylenesulfone and their inert and homogeneous liquid mixtures where such exist. By being inert, it is meant that such mixtures do not contain substituents that will chemically react with one another, in the phosphatizing solution, at the temperature attained for the solution to be at boiling condition. Dimethyl sulfoxide is useful as an aprotic organic compound; but, such may further be used as an accelerator compound, as is discussed herein below. In such case when the dimethyl sulfoxide is present as an accelerator compound, substance other than dimethyl sulfoxide is used to supply aprotic organic compound.

Another substance generally found in the phosphatizing composition is the organic accelerator compound. Such compound serves to increase the rate of formation of the coating during the phosphatizing process. Many of the useful accelerator compounds are nitrogen-containing organic compounds, and compounds that can be used include urea, pyridine, thiourea, dimethyl sulfoxide, dimethylisobutylene amine, ethylenediaminetetraacetic acid and dinitrotoluene. The use of stabilizers has been taught in the prior art and such are contemplated for use herein, such as the hydrogen and hydrogen chloride acceptor substituents that can retard the corrosive nature of phosphatizing compositions. Stabilizers against oxidation of a halohydrocarbon, for example, are also known. These can likewise assist in reducing the corrosive nature of the phosphatizing composition. Useful substances can include p-benzoquinone, p-tertiaryamyl phenol, thymol, hydroquinone and hydroquinone monomethyl ether.

The methylene chloride containing phosphatizing composition is suitable for use with any of the phosphatizing operations that can be, or have been, used with solvent phosphatizing. During phosphatizing, which will take place typically in degreaser apparatus, the vapor zone, in addition to containing trace amounts of other substances, will be found to contain methylene chloride vapor, vapor from the solubilizing solvent that solubilizes the phosphoric acid in methylene chloride as well as water vapor.

It has now been found that the resulting phosphatized metal surfaces can have enhanced topcoat adhesion when the water content of the typical phosphatizing solution is boosted. This is often accompanied by an increase in the solution content of the solubilizing solvent and/or the aprotic polar organic compound in the solution. In regard to water, the resulting adjusted solution will preferably contain above about 4 weight percent thereof, up to and including water saturation at the operating temperature of the solution. And when this is accompanied by addition of solubilizing solvent, especially for the $C_1$–$C_4$ alcohols, the resulting phosphatizing medium will typically contain from about 16 to about 20 weight percent of such alcohol and will have a specific gravity at or near its boiling point of between about 1.12 and about 1.14. Such a specific gravity, as can be determined by hydrometer, will thus be obtained at a temperature within the range of from about 95° to about 105° F. It is typical practice during the phosphatizing operation to maintain the phosphatizing solution at or near boiling condition. Under these conditions of temperature and specific quantity, commercially desirable coatings which can have augmented topcoated adhesion, will be efficiently achieved.

These adjusting ingredients can be pre-mixed as an adjuvant blend. Most usually, the solubilizing solvent will comprise the major amount of this adjuvant, and preferably will supply between about 55–70 weight percent of the composition. Further, the water and aprotic organic compound may be present is substantially equivalent amounts. Each ingredient will generally be present in an amount between about 10–30 weight percent. Additional ingredients, e.g., accelerator compound or stabilizer compound, may be present, and if so, are each often present in an amount less than 1 weight percent, basis the weight of such adjuvant composition. In a typical fresh bath make-up, the adjuvant composition and a precursor solution, with one or both of such generally containing accelerator plus stabilizer, are mixed together, with phosphoric acid being added during the blending. The percursor can be a mixture comprising methylene chloride, water and solubilizing solvent. Thus, only these two solutions plus phosphoric acid need be on hand at the inception of phosphatizing solution make-up.

The adjusted phosphatizing composition will provide a desirable phosphate coating in fast operation. Such operation may provide the phosphatized substrate with a low-coating weight, i.e., one on the order of 20–50 milligrams per square foot, or with a heavier coating weight. Such heavier coating weight, of usually above about 50 milligrams per square foot can be on the order of 100 or more, e.g., 150 milligrams per square foot. It is also contemplated that the adjusted composition can be used with a previously-phosphatized substrate having a low coating weight, as from previous solvent phosphatizing operation, to thereby provide a phosphatized substrate having a heavy coating weight, e.g., one of above 50, and preferably above about 65, milligrams per square foot, and to provide such a coating of enhanced topcoat adhesion.

The coatings that are obtained on ferrous metal will have at least substantial water insolubility, also termed "water-resistant" coatings. For determining water solubility, the test employed is sometimes referred to as the "water soak test." In this test a coated ferruginous article is weighed and then immersed in distilled water for 10 minutes. The water is maintained at room temperature, typically 65°–75° F, and with no agitation. After this ten minute immersion, the article is removed from the water, rinsed in acetone and air dried. Subsequently, on re-weighing, the amount of water solubility of the coating is shown by any weight loss. This loss is generally expressed as a percentage loss of the total original coating. The method used for determining the original coating weight has been more specifically described hereinbelow.

Advantageously, for enhanced corrosion protection, the water solubility of the coating will be on the order of less than 20% as determined by the water soak test. Such a coating, for convenience, can be termed as a "phosphatized coating of substantial water insolubility." Preferably, for best coating performance, including the ability to receive topcoating with water-based topcoat compositions, the water solubility of the coating will be less than 5%, basis total weight of the original coating.

Coatings from the phosphatizing operation that are of the iron phosphate type have been subjected to analysis by the Electron Spectroscopy for Chemical Analysis (ESCA) technique. Such analysis confirms that the coatings obtained on a ferruginous substrate, contain in their make-up, the elements sodium and calcium in trace amounts. The balance of the elements is provided by phosphorous, iron, oxygen, carbon and nitrogen. Further, for low coating weights of below about 50 milligrams per square foot, the coating will have a ratio of coating surface carbon atoms to phosphorous atoms of greater than 5:1, which has not been observed heretofore. Although all of the coatings are complex, because of the nature of the spectroscopic analysis techniques used in analyzing the coating, the make-up of the coating under analysis is expressed in the form of the elements, although the elements will or may form various bonding relationships.

Because of the augmented topcoat adhesion plus the water-resistant phosphatized coating the coating lends itself to topcoating from electrically-deposited, aqueous-based primers, such as the electrodeposition of film-forming materials in the well known electrocoating processes. Further, the phosphatized coatings can form the base coating for a water reducible topcoating. Such topcoating compositions typically contain solubilized polymers, similar to conventional alkyd, polyester, acrylic and epoxy types, that are typically solubilized with smaller amounts of organic amine. Also the resulting phosphate coated substrate can be further topcoated with any other suitable resin-containing paint or the like, i.e., a paint, primer, enamel, varnish or lacquer including a solvent reduced paint. Additional suitable paints can include the oil paints and the paint system may be applied as a mill finish.

Before applying the phosphate coating, it is advisable to remove foreign matter from the metal surface by cleaning and degreasing. Although degreasing may be accomplished with commercial alkaline cleaning agents which combine washing and mild abrasive treatments, the cleaning will generally include degreasing. Although such degreasing can be accomplished with typical degreasing systems, such degreasing can be readily and efficiently handled with methylene chloride degreasing solvent.

By way of example, a fresh phosphatizing solution that is recognized as a standard for a methylene chloride phosphatizing composition, is prepared from 100 parts of methylene chloride, 21.48 parts methanol, 0.91 part orthophosphoric acid, 4.6 parts N,N-dimethylformamide ("DMF"), 0.09 part dinitrotoluene, 0.04 part p-tertiaryamyl phenol, 4.98 parts water, and 0.03 part p-benzoquinone. All parts are weight parts. These ingredients are simply mixed together and the resulting phosphatizing composition is identified hereinafter as the "standard" composition.

A phosphatizing composition, having an adjusted constituency, is then prepared in like manner. The ingredients in this composition are the same as for the standard composition, except for the following: water content is increased from 4.98 to 6.15; methanol content is increased from 21.48 to 25.64; and the DMF content is increased from 4.6 to 5.87. Hereinafter this composition is identified as the "first adjusted" composition.

In like manner, a "second adjusted" composition is prepared wherein, on the basis of the standard composition, the following constituency is changed: the water is adjusted from 4.98 to 6.82; the methanol from 21.48 to 28.03; and the DMF from 4.6 to 6.59.

Bare steel test panels, being 6 × 4 inches cold-rolled, low carbon steel panels are used for phosphatizing. The panels are phosphatized by immersing the panels in the selected solution, first heated to its boiling point and maintained there during phosphatizing. Immersion times are varied to provide for a low coating weight and for a high coating weight, as shown in the table below. Panels removed from the respective phosphatizing solution pass through the vapor zone above such solution until liquid drains from the panel; dry panels are then removed from the vapor zone.

For all compositions, that is, the standard composition; the first adjusted composition; and the second adjusted composition, the low coating weight is 30 milligrams per square foot (mg/ft$^2$) and the high coating weight is 80 mg/ft$^2$. For determining proper coating weight from each composition, selected, coated test panels are first weighed as coated panels, then stripped of the coating by immersion in an aqueous solution of 5% chromic acid, which is heated to 160°–180° F. during immersion. After panel immersion in the chromic acid solution for 5 minutes, the stripped panel is removed, rinsed first with water and then acetone and then air dried. After this it is reweighed for the coating weight determination.

Some of the test panels, selected at random, are topcoated with a trichloroethylene-based enamel sold under the tradename "Triclene" and available from Mobil Chemical Co. After coating, this topcoat is cured at a temperature of 400° F. by stoving for 30 minutes. Other panels, also selected at random, are painted with another commercial enamel topcoat. The enamel is a white alkyd baking enamel that ostensibly contains a modified alkyd resin based upon a system of partially polymerized phthalic acid and glycerine, and has 50 weight percent solids. After coating, coated panels are cured by baking in a convection oven for 20 minutes at a temperature of 225° F.

As shown in the Table below, selected panels are subjected to the reverse impact test. In this test the weight of the metal ram is coordinated with the height of the drop to provide first the 80 inch-pounds (in-lb) as shown in the Table below, and then by height adjustment the 160 in-lb. Paint removal is determined qualitatively by observing visually the convex (reverse) surface of comparative panels and then rating them. In the rating system the following numbers are used to cover the following results:

10. complete retention of film, exceptionally good for the test used;
8. some initial coating degradation;
6. moderate loss of film integrity;
4. significant film loss, unacceptable degradation of film integrity;
2. some coating retention only;
0. complete film loss.

TABLE

| Bath | PART A (REVERSE) IMPACT) | 30 mg/ft² Coating Weight 400° F Cure Paint 80 in-lb | ENAMEL: 225° F. Cure 80 in-lb | 160 in-lb |
|---|---|---|---|---|
| Standard | | 4.5 | 6.5 | 1.0 |
| First Adjusted | | 5.5 | 10.0 | 9.0 |
| Second Adjusted | | 3.0 | 10.0 | 9.0 |
| | PART B | 80 mg/ft² Coating Weight | | |
| Standard | | 2.5 | 9.5 | 8.0 |
| First Adjusted | | 4.0 | 9.5 | 8.5 |
| Second Adjusted | | 7.0 | 10.0 | 9.0 |

As shown in the Table, the topcoat adhesion at the 160 in-lb test for the enamel is most dramatically enhanced. And this, plus the other improvements in topcoat adhesion, are accomplished by adjustment of the composition constituency, that is, without bringing a new ingredient into the composition.

We claim:

1. In the process of forming a phosphatized coating on a metal substrate, wherein coating formation proceeds through contact of the surface of said metal substrate with a methylene chloride and water-containing liquid phosphatizing composition having a continuous and homogeneous liquid phase containing water in minor amount, with the composition being capable of forming a phosphatized coating of substantial water insolubility on said surface, the improvement for forming on said surface a phosphate coating having enhanced topcoat adhesion, which improvement comprises adjusting the specific gravity of said liquid phosphatizing composition to between about 1.12 and about 1.14, as determined at a temperature within the range of from about 95° to about 105° F, by blending with said composition a constituent selected from the group consisting of water, aprotic polar organic compound, solubilizing solvent capable of solubilizing phosphoric acid in methylene chloride, and mixtures thereof, whereby the blending provides the resulting phosphatizing composition with water in an amount above about 4 weight percent, basis total weight of the composition, and then contacting the surface to be coated with the resulting phosphatizing composition.

2. The process of claim 1 wherein said blending adds aprotic polar organic compound as a new composition constituent.

3. The process of claim 1 wherein the resulting phosphatizing composition contains methylene chloride in major amount.

4. The process of claim 1 wherein the water, aprotic polar organic compound and solubilizing solvent are added to said phosphatizing composition as a preblended adjuvant composition.

5. The process of claim 4 wherein said liquid phosphatizing composition is first prepared by blending together ingredients comprising methylene chloride, solubilizing solvent, a phosphatizing proportion of phosphoric acid and water in an amount exceeding said proportion of phosphoric acid, and subsequent addition of said adjuvant adds aprotic polar organic compound thereto.

6. A methylene chloride and water containing liquid phosphatizing composition having a continuous and homogeneous liquid phase containing water in a minor amount, said composition being adapted for forming a phosphate coating on a metal substrate that provides enhanced topcoat adhesion, the composition being maintained during phosphatizing at a temperature within the range of from about 95° to about 105° F and having the proportion of the composition constituents present in amounts providing said liquid phase with a specific gravity between about 1.12 and about 1.14 at said phosphatizing temperature, wherein the composition constituency comprises methylene chloride, aprotic polar organic compound, $C_1$–$C_4$ alcohol, a phosphatizing proportion of phosphoric acid and an amount of water above about 4 weight percent, basis total weight of the composition, while being sufficient for said composition to provide a phosphatized coating of substantial water insolubility.

7. The composition of claim 6 further characterized by having a nitrogen-containing aprotic polar organic compound.

8. The composition of claim 6 further characterized by containing from about 16 to about 20 weight percent $C_1$–$C_4$ alcohol and from about 3 to 5 weight percent aprotic polar organic compound.

9. The method of preparing a methylene chloride and water-containing liquid phosphatizing composition having a continuous and homogeneous liquid phase containing water in minor amount and being adapted for forming a phosphate coating on a metal substrate that provides enhanced topcoat adhesion, wherein said phosphatizing composition is prepared by combining a precursor solution with an adjuvant, with the precursor solution containing methylene chloride, a solubilizing solvent capable of solubilizing phosphoric acid in methylene chloride and water, said adjuvant containing solubilizing solvent and water, which method comprises mixing precursor solution and adjuvant together in proportion providing said liquid phosphatizing composition with an augmented amount of adjuvant.

10. The method of claim 9 wherein said adjuvant is a blend of $C_1$–$C_4$ alcohol and water further containing aprotic polar organic compound.

11. The method of claim 10 further characterized by mixing precursor solution with sufficient adjuvant to provide said phosphatizing composition with a specific gravity between about 1.12 and about 1.14 as determined at a temperature within the range of from about 95° to about 105° F.

12. In the process of preparing a coated metal substrate wherein the surface of the metal receives a phosphatized coating and the resulting phosphatized surface is subsequently topcoated, the improvement for enhancing topcoat adhesion to a phosphatized surface of low coating weight which comprises contacting said low coating weight phosphatized surface with a methylene chloride and water-containing liquid phosphatizing composition having a continuous and homogeneous liquid phase and containing water in minor amount which composition has an augmented constituency selected form the group consisting of water, aprotic polar organic compound, solubilizing solvent capable of solubilizing phosphoric acid in methylene chloride, and mixtures thereof, thereby preparing a phosphatized surface of augmented coating weight.

13. The method of claim 12 wherein said phosphatized surface has a low coating below 50 milligrams per square foot, and the phosphatized surface of augmented coating weight has a coating above about 65 milligrams per square foot.

14. A coated ferruginous substrate having an adherent and water-insoluble surface coating that is a complex coating of the iron phosphate type, said surface coating containing, in addition to trace elements, the elements, iron, phosphorus, oxygen, carbon, and nitrogen and having a coating surface ratio of carbon atoms to phosphorus atoms of above about 5:1, with said coating being obtained by contacting said ferruginous substrate with a methylene chloride and water-containing liquid phosphatizing composition, maintained at a temperature within the range of from about 95° F to about 105° F, said composition containing water in an amount above about 4 weight percent, basis total weight of the composition, and with said composition having a specific gravity between about 1.12 and about 1.14 within said temperature range.

15. The coated substrate of claim 14 wherein said coating is present in an amount above about 65 milligrams per square foot.

16. The coated substrate of claim 14 wherein said aprotic polar organic compound is a nitrogen-containing compound.

* * * * *

UNITED STATES PATENT AND TRADEMARK OFFICE

CERTIFICATE OF CORRECTION

PATENT NO. : 4,056,409

DATED : November 1, 1977

INVENTOR(S) : Edward A. Rowe, Jr. and William H. Cawley

It is certified that error appears in the above-identified patent and that said Letters Patent are hereby corrected as shown below:

Cover page, left hand column, after "[73] Assignee: Diamond Shamrock Corporation, Cleveland, Ohio," insert — [ * ] Notice: The portion of the term of this patent subsequent to February 15, 1994, has been disclaimed —.

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*